US006054642A

United States Patent [19]

Brooks

[11] Patent Number: 6,054,642

[45] Date of Patent: Apr. 25, 2000

[54] PROTECTIVE COVER FOR A GUITAR

[76] Inventor: Margaret A. Brooks, 16350 Merriman Rd., Romulus, Mich. 48174

[21] Appl. No.: 09/162,415

[22] Filed: Sep. 28, 1998

[51] Int. Cl.[7] ..... G10D 1/08; G10D 3/00

[52] U.S. Cl. ..... 84/267; 84/291; 84/453

[58] Field of Search ..... 84/267, 291, 292, 84/453

[56] References Cited

U.S. PATENT DOCUMENTS

| | | | |
|---|---|---|---|
| D. 400,561 | 11/1998 | Vargas-Phillips | 84/453 X |
| 3,309,954 | 3/1967 | Phillips et al. | 84/453 |
| 3,443,466 | 5/1969 | Brakewell | 84/291 |
| 4,000,678 | 1/1977 | Messina | 84/453 |
| 4,334,452 | 6/1982 | Morrison et al. | 84/291 X |
| 5,627,331 | 5/1997 | Devitrysmith | 84/267 X |

*Primary Examiner*—Stanley J. Witkowski
*Attorney, Agent, or Firm*—Young & Basile, P.C.

[57] ABSTRACT

A protective device for the rear surface of a guitar, especially an electric guitar, comprising a flat pad of protective material adapted to be removably secured to the rear surface of the guitar to protect areas likely to be scratched by a player's clothing, for example by a belt buckle. In a preferred form the pad comprises a vinyl or leatherlike material with a plurality of elastic loops sized to be secured to existing guitar strap studs on the body of the guitar, or to be looped directly over the upper and lower horns of the typical electric guitar body.

16 Claims, 3 Drawing Sheets

PROTECTIVE COVER FOR A GUITAR

FIELD OF THE INVENTION

The present invention is in the field of protective covers for guitars.

BACKGROUND OF THE INVENTION

Quality guitars are expensive instruments. In addition to their being highly prized possessions of serious musicians, they can become collector items of great value. Musicians and collectors accordingly take great pains to care for and preserve the finishes of their guitars, which often consist of expensive or exotic woods and synthetics.

However, guitars are ultimately meant to be used, and their use subjects them to wear. This is especially true of electric guitars, whose use tends to be more dramatic and movement-oriented than that of classical or acoustic guitars, in keeping with the type of music for which electric guitars are best suited.

Electric guitars are especially subject to wear on the back or rear surface of the guitar body from belt buckles, buttons, zippers and other hard or abrasive items on the player's person.

A common device for protecting a guitar's surface is an elasticized terry cloth "sock " which fits over the back, sides and part of the front of the guitar body. The sock covers so much of the guitar that musicians are generally unwilling to use it during performance because of its appearance and interference with play. Moreover, the sock is not very effective in protecting the guitar's surface.

SUMMARY OF THE INVENTION

The present invention is a flat protective cover or pad adapted to be secured to existing portions of an electric guitar body such that the protective pad is held against the rear surface of the guitar body to protect it from belt buckles, jewelry, clothing studs and the like. The pad is sized to cover at least that portion of the rear surface of the guitar body which is likely to be held against the player's body, and in a preferred form is shaped to generally follow the contour of the guitar body so as to cover a major portion of the rear surface without overlapping the sides or front of the guitar.

The pad is made from a relatively flat, smooth material such as vinyl or leather, such that its outer face does not catch a player's clothing or bunch up, and its inner face does not scratch or mar the rear surface of the guitar body.

The pad material may have identical outer or inner faces, or the outer and inner faces may comprise different textures or materials to provide a desired degree of grip or friction between the pad and the guitar and/or the pad and the musician.

In a further preferred form, the pad includes attachment loops sized to fit over the commonly-found guitar strap buttons/studs at the base and often on the horns of the guitar body, and also over shaped portions of the guitar body such as the horns themselves. In a most preferred form the pad of the present invention includes three elastic attachment loops: one at the base for attachment to the typical guitar strap button, and two spaced loops at the "upper " end of the pad to fit over a guitar strap button on one horn and over the other horn directly, or over both horns.

In yet a further preferred form the protective pad is equal to or smaller than the guitar body, i.e., its surface area and contour are such that it lies against the rear surface of the guitar without overlapping the side edges or front of the guitar, remaining hidden from view during play.

The attachment loops on the pad are preferably made from a narrow, cord-like elastic material so as to be nearly invisible to the audience, especially when looped over a horn of the guitar. The loops may be colored to blend in with the color of the guitar. It is also possible to provide the protective pad with removable loops to change loop color or size, or even to move the loops to different attachment points on the pad to custom-fit a single pad to different guitars.

These and other features and advantages of the invention will become apparent upon further reading of this specification in light of the accompanying drawings described below.

DETAILED DESCRIPTION OF THE ILLUSTRATED EMBODIMENT

Figure 1:
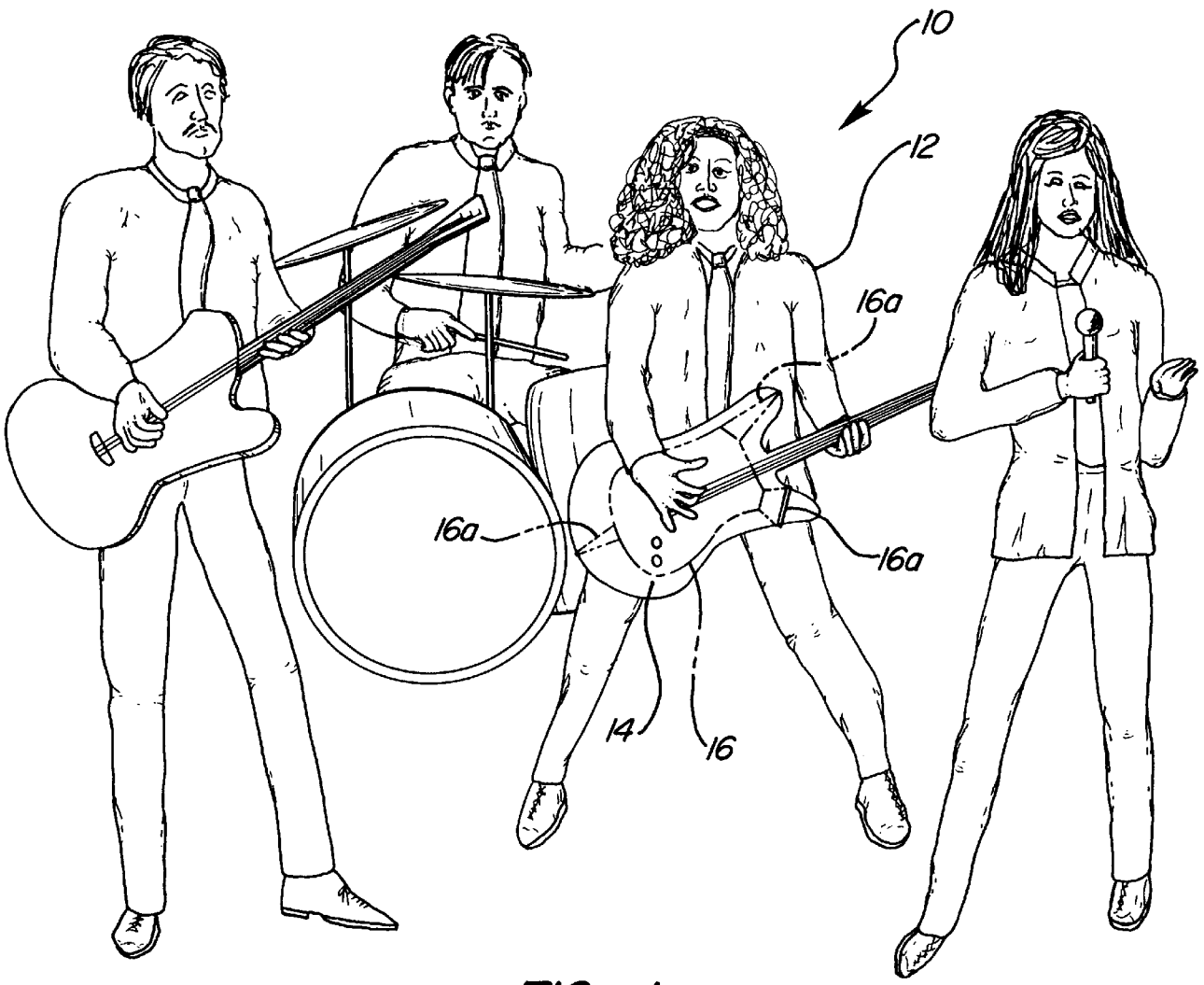
FIG. 1 illustrates a band in which one of the guitar players has a protective pad according to the present invention secured to the rear surface of his guitar, the pad being shown in phantom.

Referring first to FIG. 1, a band 10 is illustrated comprising a lead vocalist, a drummer, and lead and bass guitar players. Bass guitar player 12 is playing a guitar 14 supplied with a protective pad 16 (shown in phantom) according to the present invention. Pad 16 is secured to the rear side of the guitar, in the illustrated example by a number of elastic loops 16*a* (also shown in phantom) connected to guitar strap studs on the base and upper horn of the guitar, and looped directly over the lower horn. It will be apparent from FIG. 1 that pad 16 is hidden from the audience, with pad 16 being sized and contoured to protect that portion of the rear surface of the guitar likely to contact the player or his clothing, especially belt buckles, without overlapping the side edges or front surface of the guitar.

Another advantage in sizing and contouring the inventive pad to lie entirely within the boundaries of the rear surface of the guitar is that the pad does not interfere with the handling or play of the guitar.

From FIG. 1 it will also be clear that only a very small portion of elastic loops 16*a* might be seen by the audience where the loops engage a guitar strap stud or stretch around a horn.

Figure 2:
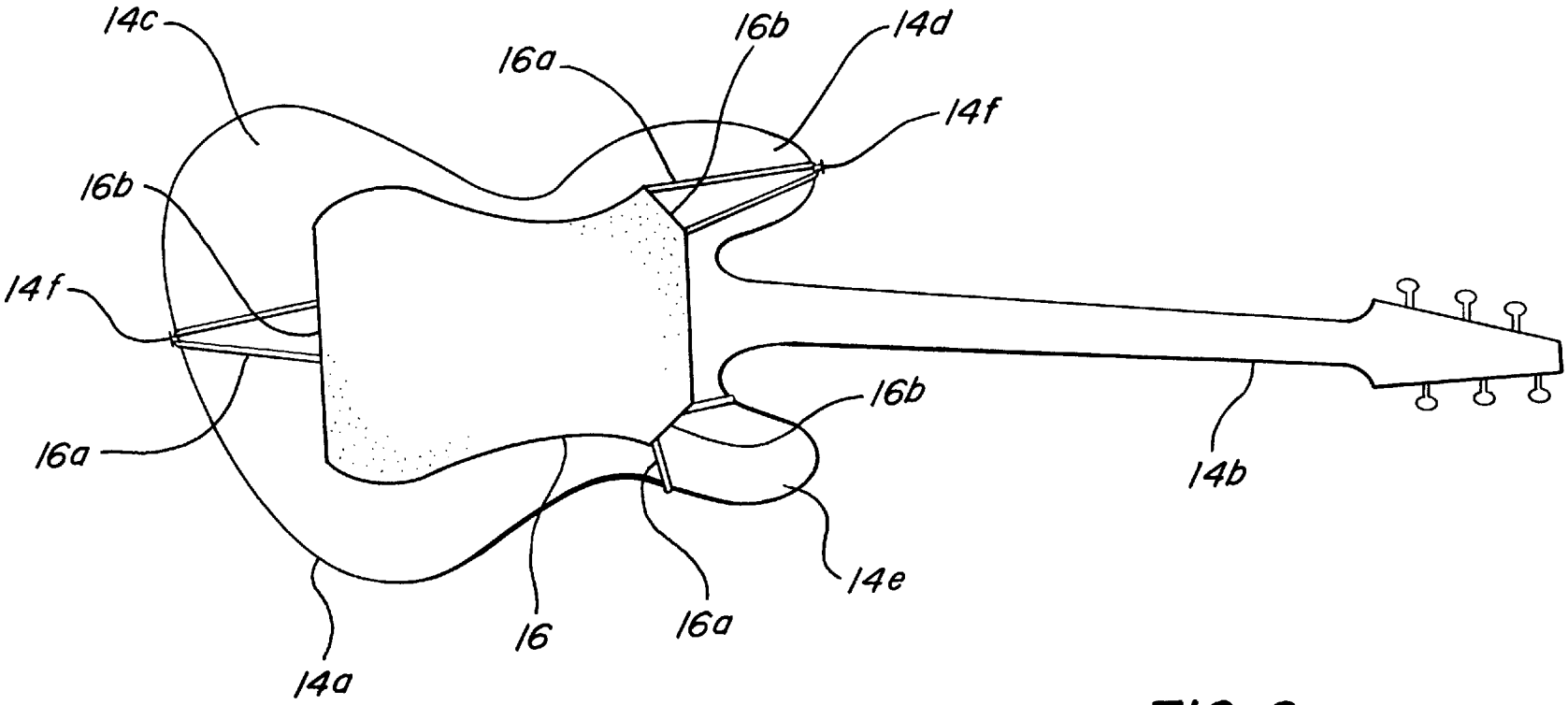
FIG. 2 is a schematic illustration of a guitar's rear surface with a protective pad according to the present invention attached thereto.

Referring next to FIG. 2, guitar 14 is shown from the rear to better illustrate inventive pad 16. Guitar 14 is illustrated as a representative example of an electric guitar comprising guitar body 14*a*, neck 14*b*, guitar body rear surface 14*c*, upper and lower "horns " 14*d* and 14*e* of a style common to electric guitars, and guitar strap studs or buttons 14*f*. It will be apparent to those skilled in the art that the inventive pad is not limited in use to the illustrated example, but can be adapted to varying contours and shapes, and is especially designed for electric guitars.

Pad 16 is secured against rear surface 14*c* of the guitar, in a most preferred form by three elastic straps or loops 16*a*, in the illustrated embodiment being formed from a small diameter elastic cord of known type. It will be apparent to those skilled in the art that other known materials can be used for loops 16*a* Also, while it is preferred that loops 16*a* are elastic for simplicity and interchangeability of connection to either studs 14*f* or horns 14*d*, 14*e*, it may be possible to use non-elastic materials with suitable adjustment mechanisms such as plastic slide locks, hooks, hook and loop fasteners such as Velcro®, straps with buckles and the like. However, the use of a small diameter, low profile elastic cord is highly preferred because it does not mar the surface of the guitar, it is simple and adjustable, it does not catch on clothing, and it can be used in a thickness equal to or less than the thickness of pad 16.

And while the most preferred form of loops 16*a* uses a closed elastic loop, closeable loops and straps could also be used.

In the illustrated embodiment, pad 16 is provided with three elastic loops 16*a*, two of which are connected to guitar strap studs 14*f* on the base and top horn 14*d* of the guitar, and a third which is stretched around the bottom horn 14*e* of the guitar. It will be appreciated that the elastic nature of the cord allows a single pad 16 to accommodate different guitars with different overall body size, guitar strap stud placement, and horn shape or location.

Loops 16*a* are secured to the base and upper two "corners " of the contoured pad 16 by loop mounts 16*b*, in the illustrated embodiment (FIG. 4) comprising tabs of the pad material folded over the base of loop 16*a* and sewn in place to hold the loop securely to the pad.

It will be appreciated by those skilled in the art that the number and location of loops 16*a* can be varied according to the size and shape of the guitar for which a particular pad 16 is intended to be used, but that the three-loop arrangement shown generally in FIG. 2 is preferred, as it can accommodate most electric guitars available today.

Figure 4:
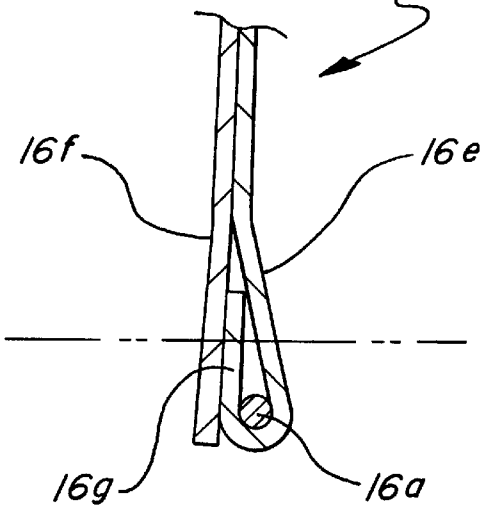
Figure 3:
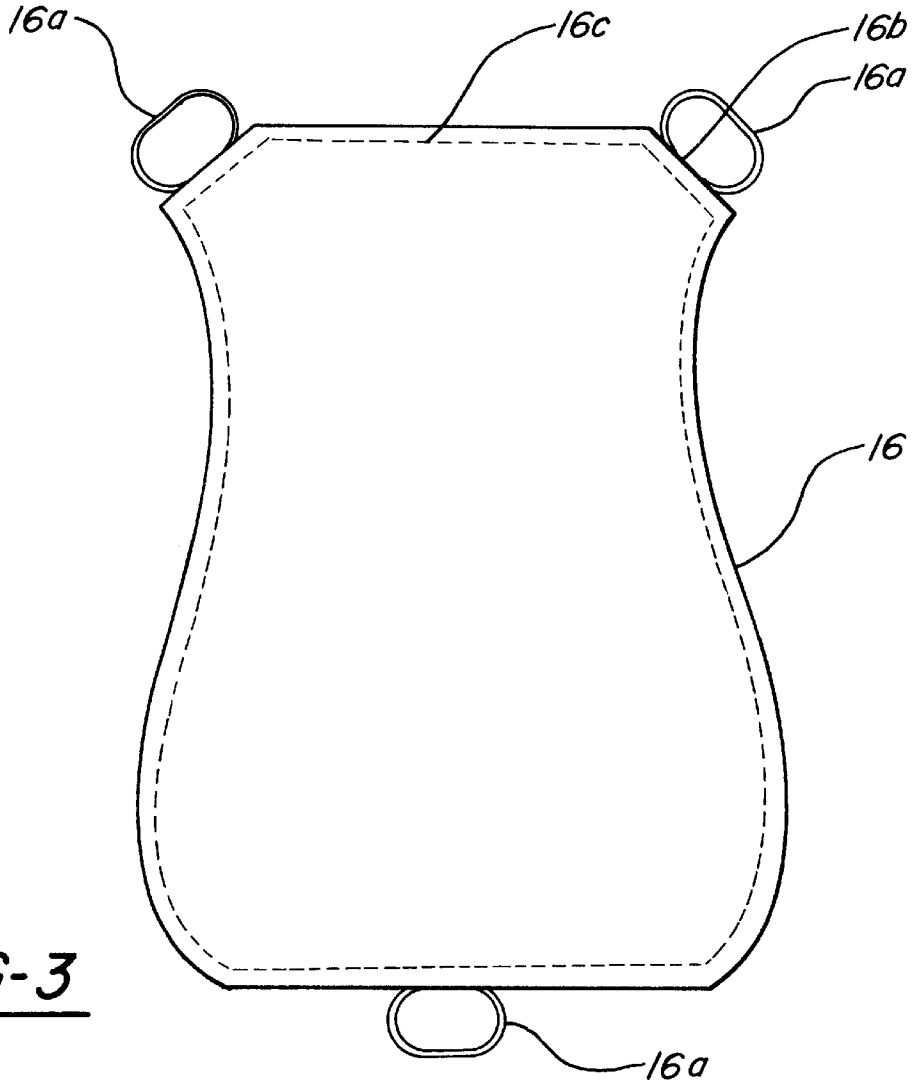
FIG. 3 is a front or rear surface view (the views being substantially identical) of a protective pad according to the present invention, removed from the guitar; and, FIG. 4 is a side section view of a sewn loop mount for an elastic attachment loops according to a preferred form of the invention.

Referring next to FIGS. 3 and 4, pad 16 is illustrated comprising two layers of smooth, protective material such as vinyl or leather, sewn together at seam 16*c*. This makes the illustrated pad reversible, since front and rear pad faces 16*e*, 16*f* (FIG. 4) are identical in texture and material. This two-layer sewn arrangement also provides a preferred structure for attaching loops 16*a* to the pad, best shown in FIG. 4. One of the layers 16*e*, 16*f* forming the pad is provided with an extra tab of material at loop mounting region 16*b*, which tab 16*g* can be folded around the base of an associated loop 16*a* and between layers 16*e*, 16*f* to be sandwiched and sewn between the two layers when seam 16*c* is created. This is a preferred arrangement for the sewn embodiment illustrated by way of non-limiting example, and it will be understood by those skilled in the art that other methods of attaching loops 16*a* to pad 16 will be apparent to those skilled in the art.

One significant advantage of the illustrated loop mounts is that only the folded tab of protective pad material is in contact with the guitar surface at each loop's attachment to the pad.

While the embodiment of pad 16 illustrated above is shown and described as comprising two identical layers of material, preferably vinyl or leather, it will be understood that two different materials can be sewn together as layers 16*e*, 16*f* for different tactile and friction characteristics as preferred by the individual musician. Leather/vinyl combinations, rough/smooth combinations, and other material/surface combinations are possible with the present invention, although the smooth/smooth surface combination is currently preferred. Pad 16 can also be made from a single layer of relatively thick, protective material.

While a preferred embodiment has been shown, it will be understood by those skilled in the art that the invention is not limited to the embodiment illustrated herein, but may be modified in ways which will be apparent to those skilled in the art now that I have disclosed this preferred embodiment and the general principles of the invention. Accordingly, the invention is not to be limited except as defined by the following claims.

I claim:

1. A protective device for a guitar, comprising:

a relatively flat, smooth pad adapted to be removably secured to the body of a guitar such that it lies against a rear surface of the guitar body at least where the rear surface is likely to be contacted by a guitar player's body or clothing during play, the pad being sized and contoured to lie entirely within the confines of the rear surface of the guitar such that it is not visible from in front of the guitar.

2. The protective pad of claim 1, wherein the pad includes a plurality of loops adapted to be secured to the guitar body.

3. The pad of claim 2, wherein the loops are elastic and are sized to interchangeably fit over electric guitar strap studs and electric guitar body horns.

4. The pad of claim 3, wherein the pad includes an elastic loop on a base portion of the pad adapted to engage a guitar strap stud on the base of an electric guitar, and two spaced elastic loops on an upper end of the pad adapted to fit over the upper and lower horns on an electric guitar.

5. The pad of claim 1, wherein the pad comprises a vinyl-like material.

6. The pad of claim 1, wherein the pad comprises a leather-like material.

7. The pad of claim 1, wherein the pad comprises inner and outer layers of the same material.

8. The pad of claim 1, wherein the pad comprises inner and outer layers of different materials.

9. The pad of claim 1, wherein the pad has inner and outer surfaces having different textures.

10. The pad of claim 2, wherein the loops have a thickness equal to or less than the thickness of the pad.

11. The pad of claim 2, wherein the pad comprises inner and outer layers of material sewn together, the loops being attached to the pad by way of a base portion of each loop trapped between sewn portions of the inner and outer layers of the pad.

12. The pad of claim 1, wherein the pad has inner and outer surfaces which are reversible.

13. The pad of claim 10, wherein the pad has inner and outer surfaces which are reversible.

14. In combination with an electric guitar of the type have a rear surface held in contact with a player's body, a guitar strap stud, an upper horn, and a lower horn, a protective pad for the rear surface of the guitar comprising a relatively flat, smooth pad sized and contoured to lie against the rear surface of the guitar in a location designed to protect it from being scratched by the player's body or clothing during play, and three elastic loops secured to the pad in locations corresponding to the guitar strap stud and the horns and capable of being stretched over the stud and horns to secure the pad against the rear surface.

15. The pad of claim 14, wherein the pad is smaller than the rear surface of the guitar so as to remain hidden from view from the front of the guitar.

16. In combination with an electric guitar of the type having a rear surface held in contact with the player's body, and one or more of a guitar strap stud, an upper horn, and a lower horn, a removable protective pad for the rear surface of the guitar comprising a relatively flat, smooth pad sized and contoured to lie against the rear surface of the guitar in a located designed to protect it from being scratched by the player's body or clothing during play, and a plurality of elastic loops secured to the pad in locations corresponding to the one or more of a guitar strap stud, an upper horn, and a lower horn, the loops being capable of being stretched thereover to removably secure the pad against the rear surface.

* * * * *